United States Patent [19]

Sleppy et al.

[11] 3,951,763

[45] Apr. 20, 1976

[54] ALUMINUM SMELTING TEMPERATURE SELECTION

[75] Inventors: William C. Sleppy, Belleville, Ill.; C. Norman Cochran, Oakmont, Pa.; Perry A. Foster, Jr., New Kensington, Pa.; Warren E. Haupin, Lower Burrell, Pa.

[73] Assignee: Aluminum Company of America, Pittsburgh, Pa.

[22] Filed: Mar. 7, 1975

[21] Appl. No.: 556,428

Related U.S. Application Data

[63] Continuation of Ser. No. 374,816, June 28, 1973, abandoned.

[52] U.S. Cl. ..... 204/67

[51] Int. Cl.[2] ..... C25C 3/06; C25C 3/18

[58] Field of Search ..... 204/67

[56] References Cited

UNITED STATES PATENTS 2,915,443 12/1959 Wallace et al. ..... 204/67

FOREIGN PATENTS OR APPLICATIONS 696,455 9/1953 United Kingdom ..... 204/67

904,740 8/1962 United Kingdom ..... 204/67

45-40649 12/1970 Japan ..... 204/67

OTHER PUBLICATIONS

Gadeau, Bull. Soc. Franc Electriciens, Ser. 6, Vol. VII, No. 74, pp. 540–544, 1947.

Antipin et al., Metallurgizdat, 1954, pp. 250, 251.

Rolin, Bull. Soc. Chim. de France, 1961, pp. 1112–1125.

*Primary Examiner*—F. C. Edmundson

*Attorney, Agent, or Firm*—Daniel A. Sullivan, Jr.

[57] ABSTRACT

A process for producing aluminum in which alumina is decomposed electrolytically to aluminum metal in an electrolyte bath between an anode and a cathodic interface formed between aluminum metal and the electrolyte bath. The bath consists essentially of $Al_2O_3$, NaF, and $AlF_3$, and has a weight ratio NaF to $AlF_3$ up to 1.1:1. During decomposition, the bath is maintained at an operating temperature greater than 40°C above the cryolite liquidus temperature of the bath and effective for preventing bath crusting in interfacial areas between bath and aluminum metal.

16 Claims, 3 Drawing Figures

ALUMINUM SMELTING TEMPERATURE SELECTION

CROSS REFERENCE TO RELATED APPLICATION

This is a continuation of application Ser. No. 374,816, filed June 28, 1973, now abandoned.

BACKGROUND OF THE INVENTION

The present invention relates to aluminum smelting and, more particularly, to the art of winning aluminum metal from $Al_2O_3$.

Conventional Hall-Heroult-type aluminum smelting cells employ a molten aluminum metal pad as a cathode and, resting on the molten pad, essentially a cryolite ($Na_3AlF_6$) electrolyte bath to which aluminum fluoride is added to reduce the weight ratio of NaF to $AlF_3$ (the bath ratio) to a range of greater than 1.1:1 and up to 1.3:1, thereby improving the current efficiency at operating temperatures around 970°C. However, attempts at operating at progressively lower bath ratios have been frustrated by the forming of a crust of frozen electrolyte over the molten aluminum pad cathode as electrolysis proceeds. This crust causes deposition of sodium, thus harming current efficiency, drastically increases resistance at the cathode, and reduces metal coalescence to the point that a cell can no longer be operated.

SUMMARY OF THE INVENTION

An object of the present invention, therefore, is to provide a method of eliminating the problem of crust formation at the electrolyte cathode interface in Hall-type aluminum smelting cells having low bath ratios.

This, as well as other objects which will become apparent in the discussion that follows, are achieved, according to the present invention, by a process for producing aluminum, including electrolytically decomposing alumina to aluminum metal in an electrolyte bath between an anode and a cathodic interface formed between aluminum metal and the electrolyte bath, the bath consisting essentially of $Al_2O_3$, NaF, and $AlF_3$, and having a weight ratio NaF to $AlF_3$ up to 1.1:1, while maintaining said bath at an operating temperature greater than 40°C above the cryolite liquidus temperature of the bath and effective for preventing bath crusting in interfacial areas between bath and aluminum metal. The cryolite liquidus temperature is that temperature at which cryolite first begins to crystallize on cooling the bath.

GENERAL ASPECTS OF THE INVENTION a. The Operation Temperature

Operating a Hall-Heroult cell at bath weight ratios NaF/$AlF_3$ equal to or below 1.1:1 has held the promise of higher current efficiencies due to lower bath operating temperatures. Higher $CO_2$/CO ratios would mean less consumption of the carbon in the carbonaceous anodes. Experimentation with baths having weight ratios of 1.1:1 or below has however presented a problem of crust formation over the molten aluminum pad cathode during electrolysis. Analysis led to the discovery that the problem must have resulted from maintaining a 20° to 30°C difference between the electrolyte bath operating temperature and its liquidus temperature, i.e., $\Delta T = 20°$ to 30°C. This temperature difference is measured at the hottest location in an industrial smelting cell. The maintaining of this 20° to 30° difference was a practice of long standing in the operation of conventional Hall-type aluminum smelting cells.

The maintaining of the 20° to 30°C difference in operating cells has been the result of several considerations. For example, this temperature difference has permitted the bath to form a protective frozen or solidified layer over and near the side linings of the cell, and it has been known that for every 1°C increase of the bath operating temperature over the bath liquidus, there is a decrease of about 0.22% in current efficiency. These two factors had indicated that a temperature difference above 30°C would be undesirable. Providing the lower limit on this temperature difference has been the concept that the liquid cavity enclosed by the frozen bath at or near the sidewalls of a cell should not become too small for efficient smelting. With this well established conceptual basis for the 20° to 30° temperature difference, the problem of electrolyte crusting over the molten aluminum pad cathode during electrolysis at low bath ratios was not attributed by those in the art to the practice of maintaining this temperature difference.

We have perceived that, if the 20° to 30° temperature difference is maintained at low bath ratio operations, i.e., low weight ratio NaF to $AlF_3$, a concentration gradient effect occurs in the catholyte region of the electrolyte directly above the molten aluminum pad cathode to result in the troublesome electrolyte crusting over the molten aluminum pad cathode. We believe the gradient results from a depletion of acid ($AlF_3$-rich) constituents in the catholyte and a concomitant enrichment in basic (NaF) constituents of the catholyte.

Figure 3:
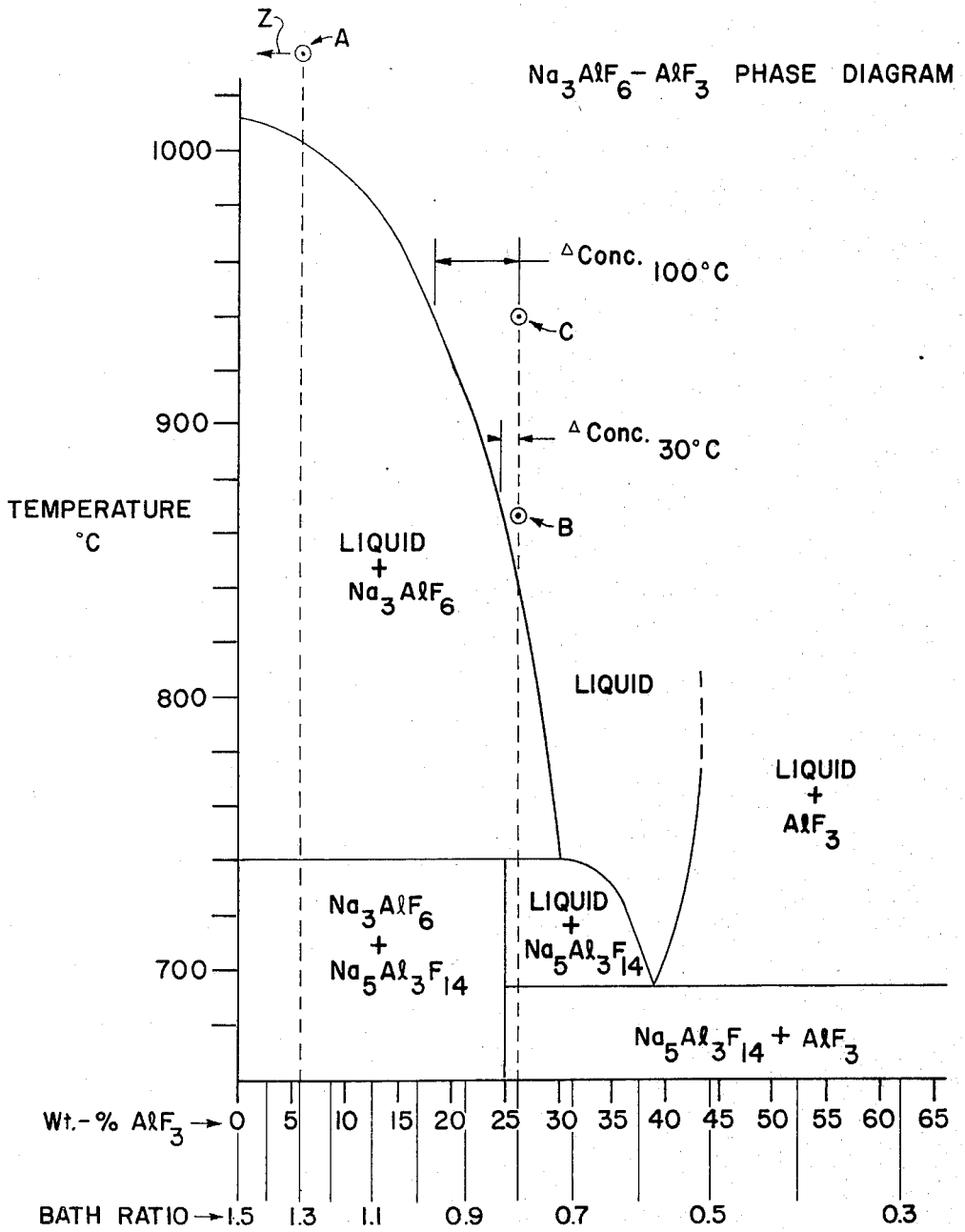
FIG. 3 is a part of the cryolite-$AlF_3$ phase diagram. The term "ΔConc." used in FIG. 3 is an abbreviation of ΔConcentration and refers to the concentration change at the indicated temperature subscript required to initiate crystallization.

A difference of 20° to 30°C between the operating temperature of the electrolyte bath and the liquidus of the electrolyte bath is sufficient for preventing crusting in the catholyte region of the higher ratio baths used in prior practice, but is insufficient to prevent crusting at lower ratios of, for example, 0.8. This is illustrated in FIG. 3. FIG. 3 is a phase diagram for a two component system, i.e. cryolite and aluminum fluoride, and it must be remembered that the situation becomes somewhat different (e.g. lower liquidus temperature) as other components, for instance $Al_2O_3$, $CaF_2$, LiF, etc., are added to the bath. Nevertheless, FIG. 3 is sufficient to convey our concept. Point A in FIG. 3 is a point 30°C above the liquidus of an electrolyte bath of 1.3 ratio, such as might be used in a Hall-Heroult cell operating according to previous practice. Enrichment in sodium will move the actual catholyte composition in the direction of arrow Z, but, as is clear from FIG. 3, composition changes in the direction of arrow Z will never result in the entering of a region in the phase diagram where solid phase might precipitate out. The situation is quite different for point B which is 30°C above the liquidus of a bath of 0.8 ratio. There, as soon as sodium enrichment in the catholyte becomes sufficiently great to move the effective composition farther to the left than the $\Delta$Concentration $_{30°C}$ indicated in the Figure, solid cryolite ($Na_3AlF_6$) can precipitate out. In this way, it becomes possible for a crust of frozen electrolyte to form over the molen aluminum pad cathode as electrolysis proceeds in a low ratio electrolyte bath operated with the 20° to 30°C difference between bath operating temperature and bath liquidus practiced in the prior art.

Having recognized the source of the problem of crusting over the molten aluminum pad cathode in low ratio baths, the problem is overcome by increasing the difference between bath operating temperature and bath liquidus temperature. This may be done by raising the operating temperature or by using an additive such as LiF to lower the liquidus temperature. For example, from FIG. 3 it can be seen that crusting over the pad cathode at a bath ratio of 0.8 is prevented by operating the electrolysis at a bath temperature lying at point C, which is 100°C above the liquidus of the 0.8 ratio bath. At this higher operating temperature, a considerably greater concentration gradient can be tolerated in the catholyte without suffering the occurrence of crusting, as is clear from the size of the $\Delta$Concentration $_{100°C}$ in the Figure as compared with the size of the $\Delta$Concentration $_{30°C}$ of the Figure.

To determine the appropriate operating temperature for any given low ratio electrolyte bath, an estimate of a proper operating temperature is first made based, for example, on the nominal two component composition of the electrolyte and FIG. 3. If crusting at the cathode-bath interface is occurring under the chosen conditions, it can be noted by the resistance given to the probing or sideways movement of a steel rod down at the interface in the electrolyte bath. Preferably, that operating temperature is chosen at which no significant crusting is occurring at the interface between the cathode pad and the electrolyte bath, it being remembered that any increase above this minimum adequate temperature means loss in current efficiency. While this procedure has been discussed for constant bath ratio, it will be recognized that a greater difference between bath operating temperature and bath liquidus may be achieved, for instance, by adding more aluminum fluoride. Also, other substances, such as LiF, may be used to lower the liquidus temperature while maintaining the bath operating temperature constant.

b. The Alumina

The alumina used in the present invention is generally fed at a rate substantially equal to that at which it is consumed or converted to aluminum, that is at the rate of electrochemical reduction thereof. Within the meaning of the term "substantially continuously" as used herein, we include adding alumina in small, separate batches at frequent intervals.

The alumina feed to any smelting cell must dissolve in the electrolyte at a rate equal to at least the rate of electrochemical reduction so that the dissolved $Al_2O_3$ content of the electrolyte is not depleted. If alumina is fed to a cell more rapidly than it can be dissolved, then solids referred to as muck accumulate on the pot bottom. Factors that influence muck formation include the maximum $Al_2O_3$ solubility in the electrolyte and the solution rate of the particular alumina chosen. The method of feeding and the quantity of $Al_2O_3$ introduced to the cell at any one time, along with the difference between cell operating temperature and the liquidus temperature of the NaF-$AlF_3$ electrolyte, are also important considerations with regard to muck formation.

The solubility and solution rate of any alumina in NaF-$AlF_3$ electrolytes depends, in part, on the temperature and weight ratio of NaF/$AlF_3$ in the fused salt bath. The maximum solubility and solution rate are found in pure molten cryolite (bath ratio 1:5) at elevated temperatures. As the bath ratio is lowered by addition of excess $AlF_3$, the temperature at which a completely liquid NaF-$AlF_3$ fused salt system can be maintained, the liquidus temperature, is sharply decreased. A decrease in $Al_2O_3$ solubility and solution rate accompany a decrease in bath ratio. Thus, while the use of low ratio fused salt mixtures as electrolytes in smelting cells permits low temperature operations, an alumina feed with properties that maximize its solution rate in the electrolyte is required. The solubility of $Al_2O_3$ in a given bath at a specified temperature is independent of the physical form of the $Al_2O_3$ charged to the electrolyte, but the solution rate of the alumina in the bath is a function of the properties of the charged alumina.

The present invention makes use of the discovery that alumina having, as compared with the "metal grade alumina" conventionally used for producing aluminum metal by the electrolytic reduction of $Al_2O_3$ in cryolite-based electrolyte, a higher LOI and a higher surface area and charged directly into contact with molten electrolyte exhibits a significantly higher solution rate. It is believed that the water content acts to instantaneously disperse the charged alumina through the electrolyte by the sudden release of steam as the charge hits the hot electrolytic bath. The well-dispersed particles then dissolve rapidly in the bath.

The thought of introducing the appreciable amounts of water in the alumina used in the present invention to an alumina electrolytic reduction bath may bring to mind the possibility of explosions. Thus British Patent Specification No. 274,108 of Societa Italiana di Elettrochimica for "Improvements in Processes for the Production of Aluminum in Electric Furnaces" states that it has not been possible in practice to use the hydrate or hydroxide of alumina directly on account of the more or less strong explosions produced by the material and the resultant projection of igneous liquid. Methods that have been proposed for avoiding this problem are to first agglomerate the hydrate and only then feed it into a molten electrolyte bath; see German Patent No. 472,006 of Feb. 21, 1929 issued to Societa Italiana di Elettrochimica in Rom for "Verfahren zur Herstellung von Aluminium". Also proposed is the charging of alumina hydrate onto the crust over a molten electrolytic bath in a Hall cell, with introduction into the bath occurring only after dehydration has been achieved; see U.S. Pat. No. 2,464,267 of Allen M. Short for "Dehydrating Alumina in the Production of Aluminum". The practice of U.S. Pat. No. 2,464,267 is to be contrasted with that of the present invention, where an alumina of relatively high water content is added directly to molten electrolyte rather than being allowed to rest for a period on a crust over molten electrolyte. It has been discovered that substantially continuous adding of the $Al_2O_3$ containing appreciable amounts of water does not lad to explosions. The evolved water appears only to disperse the charged $Al_2O_3$ rapidly to the bath, thus promoting dissolution in the bath.

The thought of purposely adding to a cell an alumina with high water content may also indicate danger of a major increase in HF evolution. It has been found that only 5 percent of the water on the alumina pyrohydrolyzes bath to produce HF fume.

The alumina to be used in the present invention may be fed to individual cells or to a plurality of cells in a potline. The cells may employ either prebaked anodes or anodes baked in situ, such as the Soderberg type.

Generally, calcining alumina hydrate, such as Bayer process alumina trihydrate will produce alumina for use in the present invention. In general, calcining temperatures in the range of about 300° to 1000°C are suitable for the purpose. Apparatus and methods for heating alumina hydrate to the desired water content and surface area in kilns or by so-called "flash" heating (see U.S. Pat. No. 2,915,365 of F. Saussol; French Patent No. 1,108,011) are well known.

Aluminas with surface areas as high as 350 $m^2/g$ can be obtained by heating $\alpha$-alumina trihydrate (gibbsite) for 1 hour at 400°C in dry air. Such materials are rapidly soluble in electrolyte baths according to the present invention.

DESCRIPTION OF THE PREFERRED EMBODIMENTS

Preferably, the bath weight ratio NaF to $AlF_3$ is less than 1.0. A ratio less than 0.9 can be used. It is presently preferred to maintain the bath ratio at a value at least greater than 0.5.

The concentration of $Al_2O_3$ dissolved in the bath should be above that at which an anode effect would occur and is selected to optimize the current efficiency of the cell. It is believed possible, perhaps on a transient basis, to have some alumina in solid, particulate form in the bath. Mucking, i.e. a settling of excessive amounts of solid alumina onto the bottom of the cell, does not occur, due to an increased alumina solubility at the metal/bath interface caused by concentration gradients in the catholyte. Because of the relatively small difference between the alumina concentration at which anode effect begins and the alumina saturation concentration in the low bath ratio operation according to the present invention, it is additionally preferred that alumina be fed to the bath in a form having a high dissolution rate. Preferred embodiments of such alumina are described below.

While the bath may consist only of $Al_2O_3$, NaF, and $AlF_3$, it is possible to provide in the bath at least one halide compound of the alkali and alkaline earth metals other than sodium in an amount effective for reducing the liquidus temperature of the bath below that which it would have if only $Al_2O_3$, NaF, and $AlF_3$ were present. Suitable alkali and alkaline earth metal halides are LiF, $CaF_2$, and $MgF_2$. In a preferred embodiment, the bath contains lithium fluoride in an amount between 1 and 15 wt. percent.

The operating temperature of the bath is preferably maintained at a temperature greater than 40°C above the cryolite liquidus temperature of the bath. The cryolite liquidus temperature is that temperature at which cryolite first begins to crystallize on cooling the bath. Where the bath composition is such that cryolite is the first substance to crystallize on cooling, the intersection of the line of the constant bath composition versus temperature with the uppermost liquidus temperature surface gives the cryolite liquidus temperature. Where $Al_2O_3$ is the first substance to crystallize, a reasonably good approximation of cryolite liquidus temperature is the "eutectic" temperature determined by finding the liquidus temperature for progressively decreasing $Al_2O_3$ content, correspondingly increasing $NaF + AlF_3$, and constant bath ratio $NaF/AlF_3$ and selecting the minimum liquidus temperature on the basis of the resulting group of liquidus temperature values. The operating temperature must be effective for preventing bath crusting in interfacial areas between the bath and the molten aluminum metal pad cathode. It is preferred that the operating temperature lie below 935°C and baths have been operated successfully at operating temperatures below 900°C, 850°C and 800°C. In some embodiments, the operating temperature is at least 70°C, sometimes at least 100°C, above the liquidus temperature of the bath.

The electrolytic decomposition of $Al_2O_3$ in the present invention may be carried out at an anode current density of 1 to 20 amperes per square inch, while current densities of 1 to 15 and 1 to 10 amperes per square inch represent preferred current density ranges.

It is additionally preferred that carbon anodes used in the present invention be protected by a water-bearing atmosphere. An appropriate water-bearing atmosphere is created when the bath is sealed off from the air and when the alumina is preferably fed onto locations of the bath surface where electrolysis gas is evolving alongside the anodes. The alumina is in the form of the herein described high dissolution rate, water containing alumina. The resulting water-bearing atmosphere prevents anode dusting, a condition which can prove intolerable for the present invention.

Up to 100% of the feed alumina, and at least 50%, more preferably at least 90%, is high dissolution rate alumina containing sufficient water to create an atmosphere above the electrolyte bath effective for preventing anode dusting. The alumina is fed substantially continuously, directly to the molten electrolyte of the cell. Water content and dissolution rate are indicated by, among other parameters, the total water and the surface area of the alumina. The term "total water" is defined herein as follows: Expose a sample of alumina to 100% humidity for several hours, then equilibrate the sample at 44% relative humidity, 25°C, for 18 hours, then accurately weigh the sample, then ignite it to 1100°C, then weigh again. The loss in sample weight on going from the equilibrated state at 44% relative humidity to the ignited state after heating at 1100°C, divided by the sample weight at 1100°C, and multiplied by 100 is the percent total water.

Surface area is measured by the Brunauer-Emmett-Teller method. See Stephen Brunauer, P. H. Emmett, Edward Teller, *J. of Am. Chem. Soc.*, V. 60, Pgs. 309–19, 1938.

The use of alumina of the high water content of the present invention is contrary to the commonly-held view set forth at p. 34 of "The Chemical Background of the Aluminum Industry" by Pearson, published by The Royal Institute of Chemistry in 1955, that alumina used in electrolytic production of aluminum should be moisture-free.

In addition, it is desirable for the alumina used in carrying out the present invention to handle and convey easily.

The properties according to the present invention that enhance the solution rate of alumina in fused NaF-$AlF_3$ salt systems also improve its ease of handling and serviceability in operations as in U.S. Pat. No. 3,503,184. Because the alumina used in the present invention has higher water content, less energy, as compared to the energy used in producing conventional metal grade alumina, is required to produce it from Bayer process hydrated alumina.

The alumina added to the bath according to the present invention may be preheated, if desired, so long as it retains the above-mentioned water content and surface area characteristics.

Preferably, the alumina has a total water of 8 to 20%, more preferably 10 to 18%.

The alumina surface area may preferably lie in the range 135 to 180 $m^2/g$.

A maximum rate of solution of alumina in a fluoride bath is obtained when heated, attrition resistant, high surface area, 8 to 20% total water alumina of 55–145 micron diameter (−100 mesh +270 mesh) particles is charged directly to the unfrozen surface of agitated bath at temperatures above its liquidus temperature continuously or in small separate portions, i.e. a time interval between separate shots equaling or less than 10 minutes. The phrase "small separate portions" is underlined because of its importance with regard to the ΔT at which the cell is operated. The ΔT is the difference between the operating temperature and the liquidus temperature of the NaF-$AlF_3$ fused salt mixture. This liquidus temperature can be lowered by addition of other salts to the bath such as $CaF_2$, LiF, $MgF_2$, etc., but for simplicity a pure NaF-$AlF_3$ system is visualized. Conventional smelting cells operate with ΔIs of 10°–30°C. In conventional operations a low ΔT is desirable since the current efficiency of the cell increases as the operating temperature decreases. Because of improved control on conventional potlines the anode cathode distance (ACD) in operating cells has been reduced in some cases to a nominal one inch distance. Since the heat input to cells depends on line electrical current and internal resistance, the low ACD has enabled the lowering of ΔT to, for example, 10°C ± 5°C. While these low ΔTs are advantageous from a current and power efficiency viewpoint, they tend to increase mucking problems in the cell even when an alumina with properties that maximize its solution rate is fed to the pots. Automatic ore feeders each of which introduces only approximately 2 lb. of $Al_2O_3$ into the bath per increment may be used. This is a reasonably low rate of introduction of $Al_2O_3$ to the cell. However, if the ΔT of the bath is low, even this quantity of alumina may be so large that the heat removed from the bath to drive off water, bring the charge to temperature, and dissolve it can easily result in localized solidification of electrolyte. If this occurs then alumina encased in solidified bath will sink to the bottom of the cell to create muck instead of dissolving. The point is, it is important to balance the size of the portion of $Al_2O_3$ fed to a pot at any given time against the ΔT of the cell. Low ΔT and large slugs of alumina will muck a pot, particularly when high surface area and water content aluminas are used.

A proper particle size distribution is advantageous with regard to ease of dissolution in a smelting cell. Fines, e.g. particle size less than 44 microns (−325 mesh), tend to dust over the surface of the molten bath, agglomerate, and sink to the bottom of the cell where they contribute to mucking problems. Large particles, having diameters, e.g. greater than 150 microns (+100 mesh), also contribute to mucking problems, particularly when they are fed in large portions to pots operating with small ΔTs. The large particles acquire a layer of solidified electrolyte on contacting molten bath which causes them to sink to the pot bottom, rather than rapidly dissolve. This is the same mechanism as that discussed earlier to explain muck formation in cells that receive $Al_2O_3$ feed in quantities too high to be accommodated by the low ΔTs. The difference is that particle sizes in excess of +100 mesh lead to muck even when ΔTs are in the vicinity of 25°C. At small ΔT, attention must likewise be paid to the heat of evaporation of the water in the alumina.

Further illustrative of the present invention are the following examples:

EXAMPLE I

This example illustrates the prior art.

Several lines of Hall-type electrolytic cells, or co-called "pots", for production of Al from $Al_2O_3$ were operated at about 980°C, bath ratios of 1.25:1 to 1.45:1, and ΔTs of 15° to 20°C. Each 1°C increases in ΔT decreased current efficiency by 0.22%.

EXAMPLE II

Bench-scale tests were made in which a crucible was heated externally from the sides by a resistance furnace. Table I shows bath ratio for the cryolite bath, percentages by weight of $Al_2O_3$ and LiF in the bath and operating conditions during production of aluminum from the alumina, including the minimum temperature for which no crusting over the metal pad was encountered and the estimated liquidus temperature. The presence of crusting was detected using a graphite probe, which is preferred over a steel probe to prevent iron contamination. A ΔT of at least 100°C is apparent for each of the several runs listed.

TABLE I

Data for Example II

| Bath Ratio | % $Al_2O_3$ | % LiF | Current Density amps/in.$^2$ | Minimum Temp. for No Crusting Over Metal Pad (°C) | Estimated Liquidus Temp. (°C) |
|---|---|---|---|---|---|
| 0.7 | 3 | 5 | 5 | 826 | 706 |
| 0.7 | 3 | 5 | 2 | 822 | 706 |
| 0.7 | 3 | 5 | 5 | 856 | 706 |
| 0.565 | 2 | 5 | 5 | 866 | <700 |
| 0.565 | 2 | 10 | 5 | 827 | <700 |

EXAMPLE III

Figure 2:
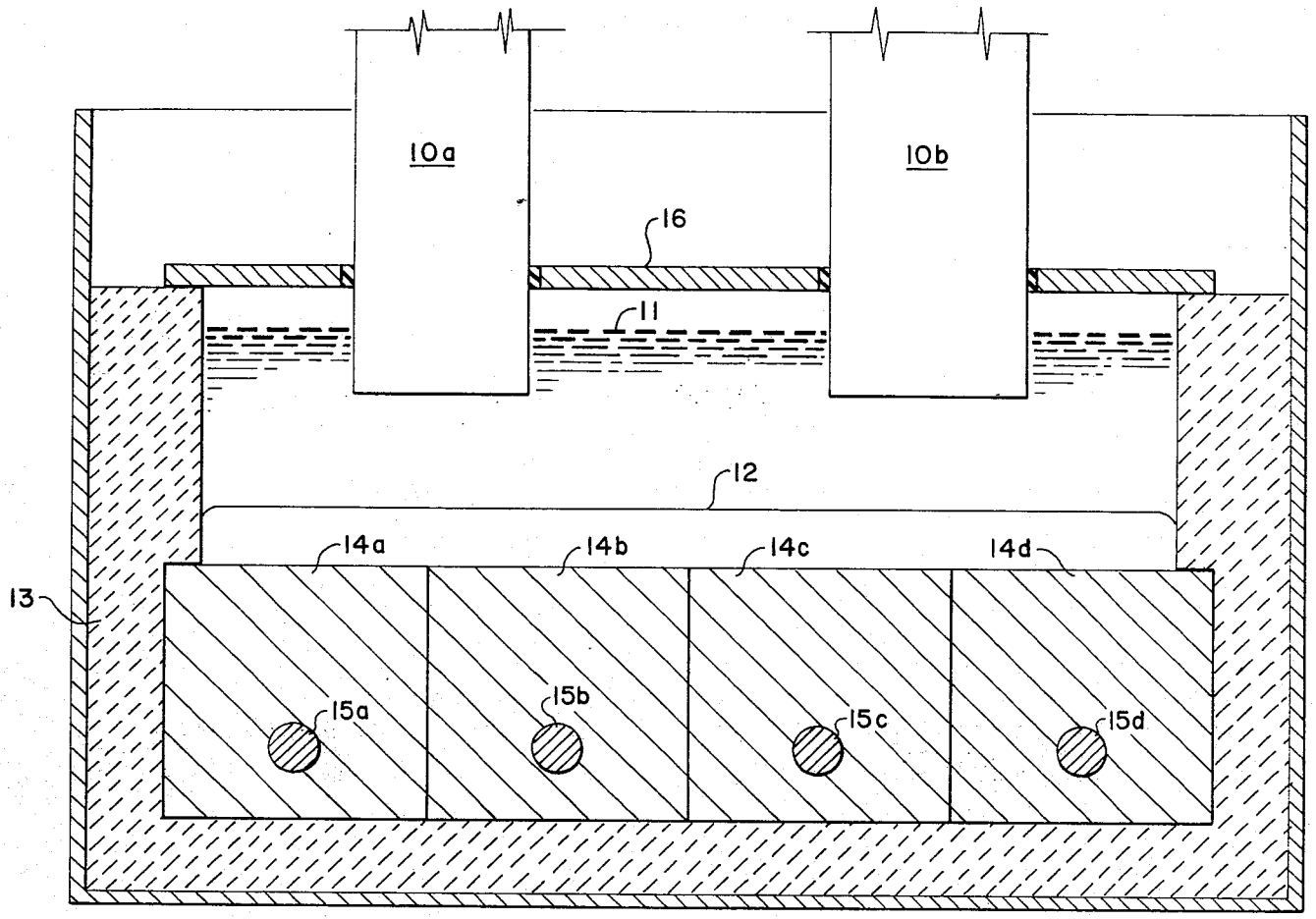
FIG. 2 is an elevational, cross-sectional view of a prebaked anode type cell for use in the present invention.

Aluminum was produced in the cell of FIG. 2 shown in longitudinal, elevational cross section. The cell had external dimensions equaling approximately 48 inches height, 89 inches length and 56 inches width. Two carbon, prebake anodes 10*a* and 10*b* were suspended into electrolyte bath 11 resting on a pad of molten aluminum 12. The molten bath and aluminum were contained laterally by refractory, non-conductive material 13. Refractory material 13 includes a side lining in contact with the molten bath and the molten aluminum and other outwardly situated insulating material with internal structural members of, for example, steel. Refractory alumina brick and silicon carbide brick were the particular side lining materials chosen in this example. Lining the bottom of the cell were graphite blocks 14*a* through 14*d*, which were connected into the electrical system by steel bars 15*a* to 15*d*. Alumina was fed to bath 11 through a suitable port (not shown) in graphite rool 16; the particular alumina used for feed had a surface area of 245 meters$^2$ per gram and a total water of 13%. Graphite roof 16 functioned to seal the bath from the air. The electrolyte bath 11 had a composition of 5% LiF and 4 to 5% $Al_2O_3$, with the balance being cryolite and $AlF_3$ in proportions giving a weight ratio $NaF/AlF_3$ equals 0.8. $Al_2O_3$ would be the first substance to precipitate when cooling bath 11. The liquidus for $Al_2O_3$-precipitation in the bath at 5% $Al_2O_3$ is 911.5°C. At 4% $Al_2O_3$, the liquidus is 863.0°C. Bath operating temperature in FIG. 2 was 910 ± 10°C. No crusting was noted at the interface between the molten aluminum cathode and the bath. The cryolite liquidus, as estimated by the "eutectic" temperature (determined as explained above) at bath ratio = 0.8 was 815°C.

EXAMPLES IV and V

Figure 1:
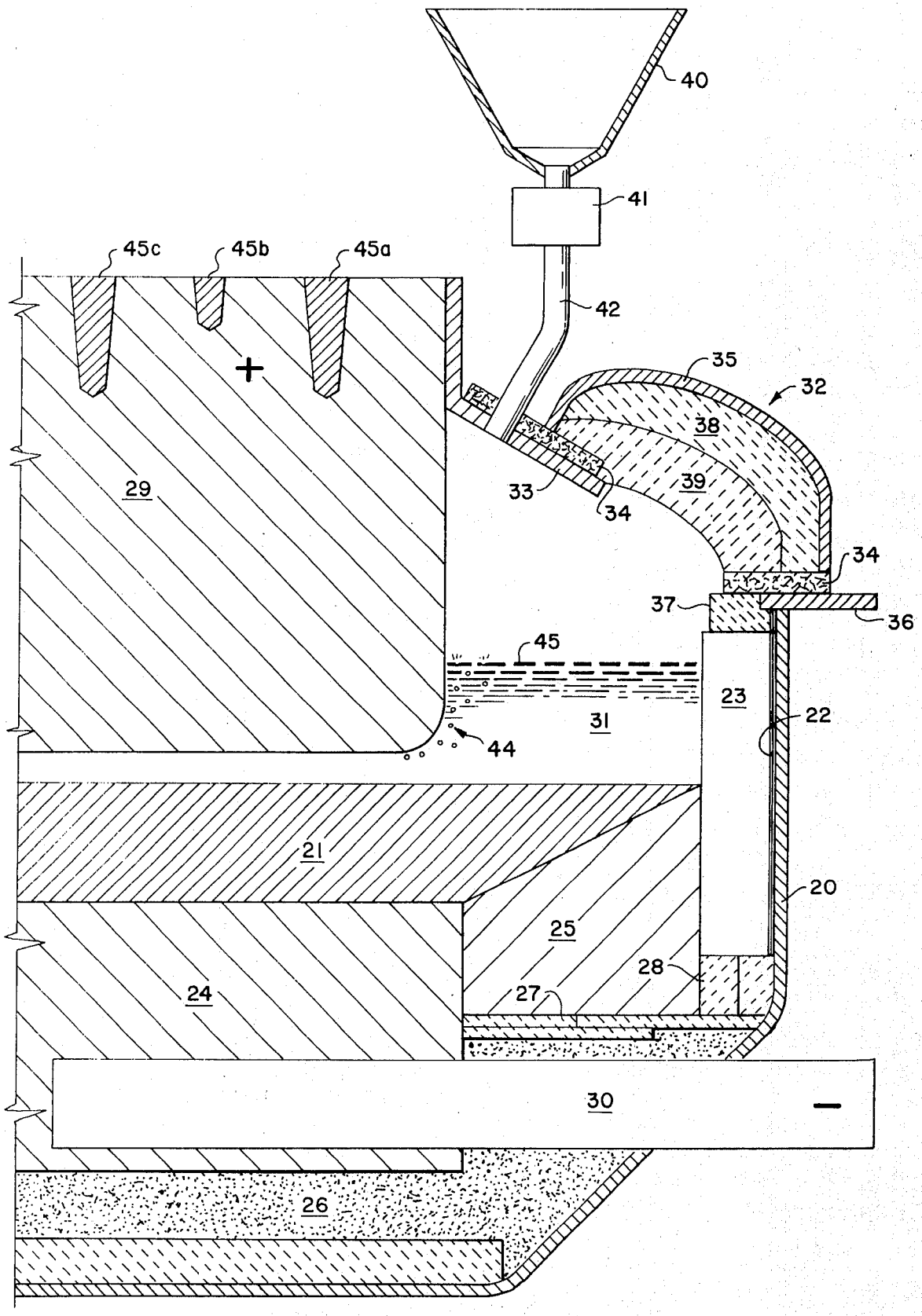
FIG. 1 is an elevational, cross-sectional, broken-away view of a Soderberg anode type cell for use in the present invention.

Aluminum was produced in the cell of FIG. 1. The maximum dimensions of the steel shell 20 in the horizontal were 18 feet 6 inches × 10 feet 2 inches. Its maximum height was 3 feet 9 inches. The maximum dimensions of the molten aluminum metal pad 21 in the horizontal were 17 feet 8 inches × 9 feet 4 inches. The electrolyte bath had the same maximum dimensions as the metal pad.

A mioamat 22 was provided between the steel shell 20 and graphite block 23 for the purpose of preventing current flow through shell 20. Mat thicknesses of from 6 to 20 mils have been used.

The metal pad 21 of aluminum was supported on carbonaceous cathode block lining 24 and carbonaceous tamped lining 25. The carbonaceous linings were supported on an alumina fill 26, there being interposed between the tamped lining and the fill some quarry tile 27. A layer of red brick 28 was provided between the graphite block 23 and quarry tile 27.

FIG. 1 is a representative vertical section through the cell and it will be realized that, for instance, similar graphite blocks 23 would appear in other elevational sections through the cell.

The anode 29 was a Soderberg-type carbon anode. The composition charged to form this self-baking anode was 31% pitch of softening point equals 98°–100°C (cube-in-air method) and 69% petroleum coke. The coke fraction was 30% coarse, 16% intermediate, and 54% fine, the size distribution of the coarse, intermediate, and fine coke being given in Table II.

TABLE II

| Tyler Sieve | Coke Size Distributions Cumulative % Greater Than Sieve Size: Coarse | Intermediate | Fine |
|---|---|---|---|
| .371 | 31.1 | | |
| 3 | 50.6 | | |
| 4 | 66.8 | | |
| 8 | 91.7 | 11 | |
| 14 | 97.9 | 48.9 | |
| 28 | 98.8 | 75.5 | |
| 48 | 99.1 | 93.5 | 2.4 |
| 100 | 99.4 | 98.0 | 10.4 |
| 200 | 99.7 | 99.0 | 39.7 |
| pan | 100 | 100 | 100 |

The cathode current was supplied through steel collector bars, such as bar 30, to the block lining 24. The current supply is indicated by the plus and minus signs on the anode and on collector bar 30 respectively.

The space above the bath 31 was sealed from the surrounding air by closure 32, including a cast iron manifold 33, Ceraform Refractory board 34, which is a soft (for obtaning a good seal) fibrous electrical and heat insulating board available from the Johns-Manville Co., steel shell 35, steel plate 36, and fire clay brick, e.g. 50% $Al_2O_3$ and 50% $SiO_2$, 37. Within shell 35 there was provided a castable 38 serving a primarily insulative function and a castable 39, e.g. calcium-aluminate-bonded tabular alumina, selected for its refractory properties. The particular heat transfer situation was chosen to maintain the upper surface 45 of bath 31 substantially in molten condition, i.e. free of any crusting.

Alumina is charged from hopper 40 through a fill valve and feeder assembly 41 of the type disclosed in U.S. Pat. No. 3,681,229 issued Aug. 1, 1971 to R. L. Lowe entitled "Alumina Feeder". Measured quantities of alumina are fed onto the exposed molten bath surface through Inconel-600 pipe 42. The distance between the bottom of pipe 42 and the top of bath 31 is about 1 foot. The feeder 41 is a shot-type feeder, i.e. separate quantities of alumina are fed at timed intervals. In Examples IV and V, two feeders 41 were used, and these fed-in alumina approximately every five minutes, the quantities of alumina being adjusted to maintain the desired alumina concentration in the bath. It takes about 1 minute to discharge the alumina increments which were about 1500 grams. Pipe 42 is directed so as to impinge alumina onto the bath 31 where gas 44 is rising alongside the anode. This assures that the water evolved from the charged alumina protects the anode against production of carbon dust therefrom. This practice also promotes dissolution because of the bath agitation caused by the gas evolution. By charging the alumina in line with a spike row (spikes 45*a*, *b*, and *c* lie in a vertical plane parallel to the plane of FIG. 1, which plane also contains pipe 42) in the Soderberg anode (cracks usually occur in the anode in line with spike rows), the dissolution rate is enhanced by the increased gas evolution occurring at the cracks. Feeders 41 were operated using air as the fluidizing medium, it being recognized that this represents a small leakage of air past cover 32 to the bath.

The particular alumina used for Examples IV and V had a total water of 16.95%. This kiln activated hydrate (KAH) alumina was 98% plus 325 mesh and its water content alone was sufficient to prevent anode dusting, i.e. decomposition of the anode such that carbon particles build up in and on the bath.

The production data for Examples IV and V are presented in Tables III to V.

Table III

| Pot Production Data | | |
|---|---|---|
| Data Name | Example No. IV | V |
| Pot Days Operated | 32 | 96 |
| Total Lbs. Net Aluminum (Al) | 35,172 | 110,740 |
| Lbs. Net Al/Pot-Day | 1099.2 | 1153.5 |
| Average % Al | 99.74 | 99.75 |
| Electrical Current Efficiency | 92.6 | 90.0 |
| Kilowatt-Hours/Lb. of Al | 7.49 | 7.76 |
| Anode Effects/Pot-Day | .91 | 1.21 |
| Lbs. Soderberg Paste/Lb. Net Al | .56 | N.M.[1] |
| Lbs. Cryolite Used | 1850 | 3600 |
| Lbs. Fluoride Used | 6105 | 21,731 |
| Lbs. $LiCO_3$ Used | 682 | 1400 |
| Anode to Cathode Distance, inches | 1.4 | 1.5 |

[1]N.M. = not measured

Table IV

| Pot Electrical Data | | |
|---|---|---|
| Data Name | Example No. IV | V |
| Volts/Pot | 5.13 | 5.17 |
| Average Amperes | 66,874 | 72,207 |
| Kilowatts/Pot | 343.1 | 373.3 |
| Ohmic Voltage Drop in Bath | 1.70 | 1.68 |

Table V

| Pot-Bath Data | | |
|---|---|---|
| Data Name | Example No. IV | V |
| Wt.-% $CaF_2$ | 3.11 | 3.17 |
| Wt.-% $Al_2O_3$ | 4.09 | 4.00 |
| Wt.-% $AlF_3$ | 48.97 | 45.08 |
| Wt.-% LiF | 5.61 | 10.165 |
| Wt.-% NaF | 38.13 | 36.94 |
| Wt.-% $MgF_2$ | .38 | .28 |
| Liquidus Temperature, °C | 882 | 906 |
| Calculated Wt.-Ratio $NaF/AlF_3$ | .78 | .82 |
| Calculated Wt.-% Cryolite | 63.4 | 61.9 |
| Calculated Excess $AlF_3$ | 23.4 | 20.5 |
| Bath Operating Temperature, °C | 898 | 922 |
| "Eutectic" Temperature, °C | 799 | 814 |
| Conductivity, $ohm^{-1}inches^{-1}$ | 4.87 | 5.67 |
| Bath Depth, inches | 8.26 | 7.62 |
| Metal Depth, inches | 6.02 | 6.25 |

With special reference to Table V, the excess $AlF_3$ indicates the quantity of $AlF_3$ above that present under the heading cryolite, formula $3NaF.AlF_3$. In each of examples IV and V, $Al_2O_3$ would be the first substance to crystallize on going below the given liquidus temperature. The eutectic temperature provides an estimate of the cryolite liquidus temperature in this case. The eutectic temperature is determined by finding the liquidus temperature for progressively decreasing $Al_2O_3$ content, correspondingly increasing $NaF + AlF_3$, and constant bath ratio $NaF/AlF_3$ and selecting the minimum liquidus temperature on the basis of the resulting group of liquidus temperature values. The $Al_2O_3$ in solution is that at the particular bath operating temperature. Conductivity data is likewise for the given operating temperature.

Gases evolved from the Soderberg anode (e.g. hydrocarbons), fluorides from the bath, and anode reaction gas (e.g. $CO_2$) were vented from cover 32 through an opening (not shown) and passed through a burner to burn the hydrocarbons. Because it is difficult to provide an absolute sealing of the bath from the air using cover 32, i.e. leaks can be present in cover 32, a pressure of 0.03 to 0.1 inches of $H_2O$, measured negatively from atmospheric pressure, is maintained between cover 32 and the burner in order to prevent fume leakage from the cover 32. The burned gases were then fed to a scrubber system.

It will be understood that the above description of the present invention is susceptible to various modifications, changes, and adaptations and the same are intended to be comprehended within the meaning and range of equivalents of the appended claims.

All percentages herein are percent by weight unless indicated otherwise.

What is claimed is:

1. A process for producing aluminum, comprising electrolytically decomposing $Al_2O_3$ to aluminum metal in an electrolyte bath between an anode and a cathodic interface formed between aluminum metal and the electrolyte bath, the bath a. consisting essentially of $Al_2O_3$, NaF, and $AlF_3$, and b. having a weight ratio NaF to $AlF_3$ up to 1.1:1, while maintaining said bath at an operating temperature a. greater than 40°C above the cryolite liquidus temperature of the bath, and b. effective for preventing bath crusting in interfacial areas between bath and aluminum metal.

2. A process as claimed in claim 1, wherein said ratio is less than 1.0.

3. A process as claimed in claim 1, wherein said ratio is less than 0.9.

4. A process as claimed in claim 1, said bath containing at least one halide compound of the alkali and alkaline earth metals other than sodium, in an amount effective for reducing said liquidus temperature below that possessed by a bath consisting only of $Al_2O_3$, NaF, and $AlF_3$.

5. A process as claimed in claim 4, wherein said halide compound is selected from the group consisting of LiF, $CaF_2$, and $MgF_2$.

6. A process as claimed in claim 1, said bath containing lithium fluoride in an amount between 1 and 15 weight percent.

7. A process as claimed in claim 1, said operating temperature being below 935°C.

8. A process as claimed in claim 1, said operating temperature being below 850°C.

9. A process as claimed in claim 1, said operating temperature being below 800°C.

10. A process as claimed in claim 1, wherein said operating temperature is at least 70°C above the cryolite liquidus temperature.

11. A process as claimed in claim 1, wherein said operating temperature is at least 100°C above the cryolite liquidus temperature.

12. A process as claimed in claim 1, said decomposing being carried out at a current density of 1 to 20 amperes per square inch.

13. A process as claimed in claim 1, said decomposing being carried out at a current density of 1 to 15 amperes per square inch.

14. A process as claimed in claim 1, said decomposing being carried out at a current density of 1 to 10 amperes per square inch.

15. A process for producing aluminum, comprising electrolytically decomposing $Al_2O_3$ to aluminum metal in an electrolyte bath between an anode and a cathodic interface formed between aluminum metal and the electrolyte bath, the bath a. consisting essentially of $Al_2O_3$, NaF, and $AlF_3$, with lithium fluoride present in an amount between 1 and 15 weight percent, and b. having a weight ratio NaF to $AlF_3$ up to 1.1:1, while maintaining said bath at an operating temperature effective for preventing bath crusting in interfacial areas between bath and aluminum metal.

16. A process for producing aluminum, comprising electrolytically decomposing $Al_2O_3$ to aluminum metal in an electrolyte bath between an anode and a cathodic interface formed between aluminum metal and the electrolyte bath, the bath a. consisting of $CaF_2$, LiF, $MgP_2$, $Al_2O_3$, NaF, and $AlF_3$, b. having a weight ratio NaF to $AlF_3$ up to 1.1:1 while maintaining said bath at an operating temperature a. greater than 40°C above the cryolite liquidus temperature of the bath, and b. effective for preventing bath crusting in interfacial areas between bath and aluminum metal.

* * * * *

UNITED STATES PATENT AND TRADEMARK OFFICE

CERTIFICATE OF CORRECTION

PATENT NO. : 3,951,763

DATED : April 20, 1976

INVENTOR(S) : William C. Sleppy et al.

It is certified that error appears in the above-identified patent and that said Letters Patent are hereby corrected as shown below:

| | |
|---|---|
| Col. 3, line 12 | Change "molen" to --molten--. |
| Col. 5, line 3 | Change "lad" to --lead--. |
| Col. 7, line 37 | Change "ΔIs" to --ΔTs--. |
| Col. 8, lines 35-36 | Change "co-called" to --so-called--. |
| Col. 9, line 18 | Change "rool" to --roof--. |
| Col. 9, line 46 | Change "mioamat" to --mica mat--. |
| Col. 11, line 55 | Put quotation marks around the word "eutectic". |
| Col. 11, line 57 | Put quotation marks around the word "eutectic". |

Signed and Sealed this

Thirteenth Day of July 1976

[SEAL]

*Attest:*

RUTH C. MASON
*Attesting Officer*

C. MARSHALL DANN
*Commissioner of Patents and Trademarks*

UNITED STATES PATENT AND TRADEMARK OFFICE

CERTIFICATE OF CORRECTION

PATENT NO. : 3,951,763

DATED : April 20, 1976

INVENTOR(S) : William C. Sleppy et al.

It is certified that error appears in the above-identified patent and that said Letters Patent are hereby corrected as shown below:

Col. 14, line 4 Change "$MgP_2$" to --$MgF_2$--.

Signed and Sealed this

*Tenth* Day of *January 1978*

[SEAL]

*Attest:*

RUTH C. MASON
*Attesting Officer*

LUTRELLE F. PARKER
*Acting Commissioner of Patents and Trademarks*